United States Patent [19]

Johnson

[11] 4,358,898

[45] Nov. 16, 1982

[54] PROTRACTOR

[76] Inventor: Edward C. Johnson, 84 Grove St., Shrewsbury, Mass. 01545

[21] Appl. No.: 207,287

[22] Filed: Nov. 17, 1980

[51] Int. Cl.[3] ..... B43L 7/06; B43L 13/08

[52] U.S. Cl. ..... 33/424; 33/1 N; 33/499

[58] Field of Search ..... 33/418, 403, 422, 421, 33/423, 424, 425, 452, 465, 471, 495-500, 195, 430, 174 E, 174 C, 174 N, 174 S, 1 N, 174 R, 174 A

[56] References Cited

U.S. PATENT DOCUMENTS

| | | | |
|---|---|---|---|
| 655,005 | 7/1900 | Penfield . | |
| 1,292,957 | 12/1919 | Maddox . | |
| 1,774,731 | 9/1930 | Sjobring . | |
| 2,361,807 | 10/1944 | Wolfe | 33/75 |
| 2,578,077 | 12/1951 | McKnight | 33/424 |
| 2,689,406 | 1/1953 | Stromquist | 33/115 |
| 2,920,392 | 1/1960 | Stromquist | 33/75 |
| 2,959,861 | 11/1960 | Stromquist | 33/94 |

FOREIGN PATENT DOCUMENTS

| | | | |
|---|---|---|---|
| 26711 | of 1896 | United Kingdom | 33/418 |

*Primary Examiner*—Harry N. Haroian
*Attorney, Agent, or Firm*—Blodgett & Blodgett

[57] ABSTRACT

A protractor consisting of a flat base having two straight edges and a degree scale, a measuring arm mounted on the base for rotation about a pivot point and having straight edges for cooperating with the straight edges of the base to form angles corresponding to angles to be measured, an indicator arm mounted on the measuring arm for rotation about the pivot point, and having an indicator mark, and locking means for fixing the indicator arm in plurality of predetermined positions on the measuring arm so that, in each position, the angle indicated by the mark on the scale coincides with the angle formed between one of the straight edges of the base and one of the straight edges of the measuring arm.

10 Claims, 9 Drawing Figures

10
16
30
46b
46a
56
50
14
50
35
46c
57
44
60
26
34
16
90°
59
22
55
180°
12
23
12
38
41
40

12
10
38
16
30
46c
46b
56
50
26
35
41
60
44
44
46a
90°
34
180°
23
12
22
62
14
63

12
41
22
40
23
10
65
66
14
38
90°
30°
30
46c
16
35
44
46a
24
46b
60
56
50

10
26
34
35
67
69
68
14
40
41
12
23
22
50
56
46a
60
38
24
46c
46b
30
44
16

PROTRACTOR

BACKGROUND OF THE INVENTION

The present invention is directed generally to a protractor and, more specifically, to a protractor for use by draftsmen and machinists.

Protractors are made for a variety of purposes. Some are designed specifically for draftsmen and others for machinists and mechanics. A draftsmen's protractor includes a generally semi-circular base having a straight edge and a 180° scale. A measuring arm is pivotally mounted on the base for measuring the angle of a line relative to the straight edge of the base. This type of protractor is capable of measuring all angles between 0° and 360° on a planar surface. However, the draftsmen's protractor is not acceptable for use by a machinist or mechanic. It is awkward to use on machine surfaces; also, it is capable of measuring only certain angles between adjacent machine surfaces and cannot be used to measure inside angles.

The conventional machinists protractor includes a base having two right angle edges and a 90° arcuate scale of markings. A measuring element is pivotally mounted on the base and has a measuring arm that cooperates with one of the straight edges of the base and an indicator arm integrally formed with the measuring arm provided with a measuring mark adapted to coincide with the marks on the arcuate scale. One straight edge of the base is placed along one surface and the measuring element is swung so that a straight edge of the measuring arm lies along an adjacent surface. The angle between the two surfaces is determined by viewing the position on the scale of the mark on the indicator arm. The protractor is capable of measuring inside angles between 90° and 180°. However, there are many outside angles that cannot be measured. Various machinists protractors have been developed to overcome this deficiency of machinists protractors. Such protractors include additional indicator and measuring arms resulting in a complicated and expensive protractor. In addition, the specialized machinists protractors are unacceptable for use by draftsmen. These and other difficulties experienced with the prior art devices have been obviated in a novel manner by the present invention.

It is, therefore, an outstanding object of the invention to provide a protractor which can be used by both machinists and draftsmen.

Another object of the invention is the provision of a protractor that is capable of measuring all angles on a planar surface and most inside and outside angles between adjacent machine surfaces.

A further object of the present invention is the provision of a protractor having a single measuring arm and a single indicator arm that has the measuring range of protractors employing multiple indicators and measuring arms.

It is another object of the instant invention to provide a protractor in which the indicator arm is adjustable relative to the measuring arm to increase the measuring range of the protractor.

A still further object of the invention is the provision of a protractor which is simple in construction and which is easy to use.

It is a further object of the invention to provide a protractor which is inexpensive to manufacture and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a protractor having a flat base, a measuring arm pivotally mounted on the base, an indicator arm pivotally mounted on the measuring arm, and locking means for fixing the indicator arm in a plurality of predetermined positions on the measuring arm. The flat base has a corner portion between a pair of straight edges arranged at a right angle and an arcuate scale marked in degrees and generated from a point on the corner portion. The measuring arm and indicator arm are each mounted for rotation about this same point. The measuring arm has straight edges that cooperate with the straight edges of the base to form an angle corresponding to the angle to be measured, also, the indicator arm has an indicator mark spaced from the point that coincides with the degree scale. The angle indicated by the mark on the scale coincides with the angle formed between at least one of the straight edges on the measuring arm and one of the straight edges on the base. The range of angles measured by the protractor is different for each of the predetermined positions of the indicator arm relative to the measuring arm.

More specifically, the corner portion of the base has a circular edge concentric with the pivot point. The measuring arm and indicator arm each have a circular end edge that is coincidental with the circular edge of the base. The locking means consists of a detent or dog slidably mounted on the measuring arm for engaging one of a plurality of spaced notches in the indicator arm.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
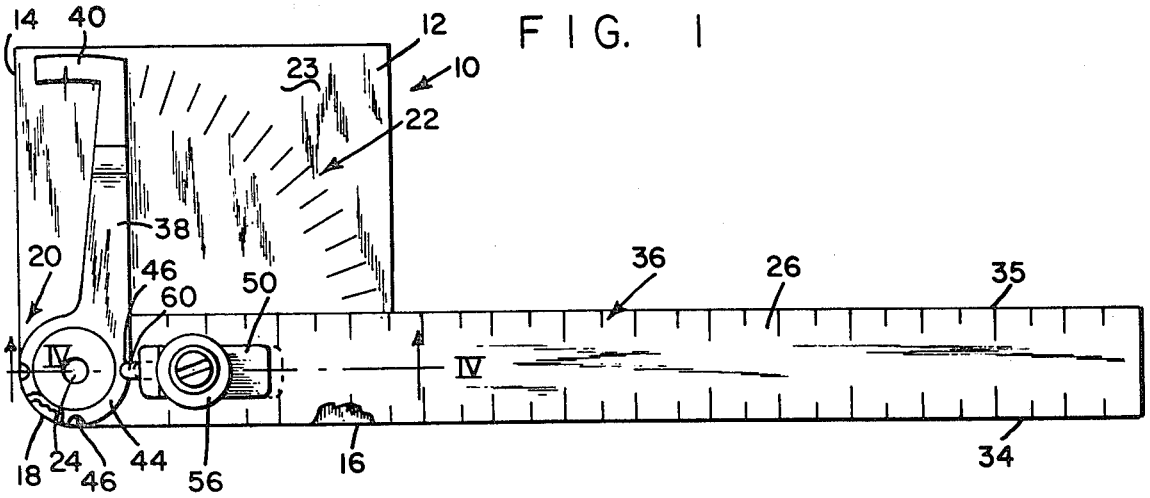
FIG. 1 is a front elevational view of a protractor embodying the principles of the present invention.
Figure 2:
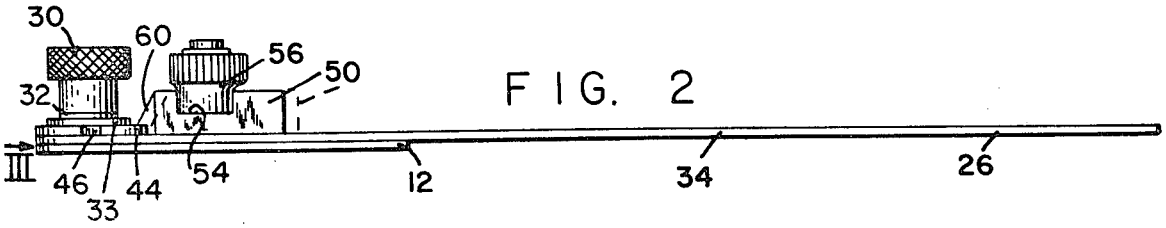
FIG. 2 is an edge view of the protractor.
Figure 3:
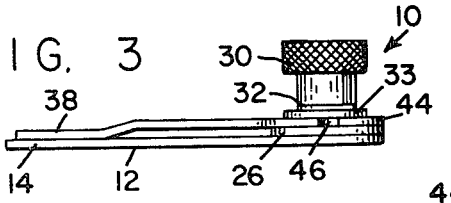
FIG. 3 is an end edge view of the protractor looking in the direction of arrow III in FIG. 2.

Referring first to FIGS. 1, 2 and 3, the protractor, embodying the general features of the present invention, is generally indicated by the reference numeral 10. The protractor has a flat base 12 having a first straight edge 14 and a second straight edge 16 that extends at a right angle to the first straight edge. A circular curved edge 18 is located between and is contiguous with the straight edges 14 and 16. The curvature of edge 18 is generated about a point located equadistant from the edges 14 and 16 on a corner portion 20 of the base 12. The upper surface of the base, indicated by the reference numeral 23, is scribed with an arcuate degree scale, generally indicated by the reference numeral 22, which extends along a circular arc generated from the point on the corner portion 20. This point is located on the vertical axis 25, (see FIG. 4).

Figure 4:
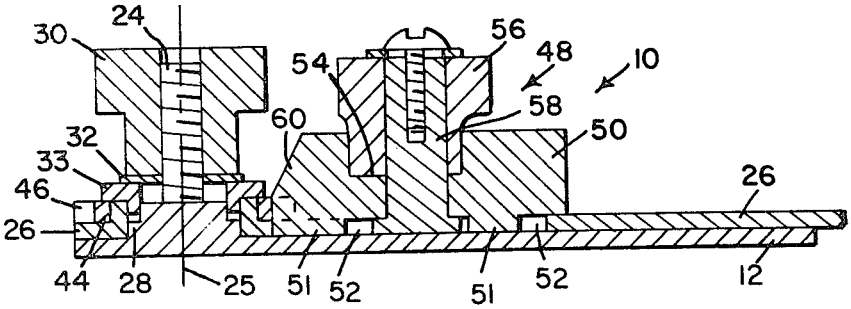
FIG. 4 is a fragmentary vertical sectional view taken along line IV—IV of FIG. 1 and looking in the direction of the arrows.

Referring to FIGS. 1–4, a measuring arm 26 is mounted on the base 12 for rotation about the vertical axis 25, (see particularly FIG. 4). The end of the arm 26 is freely mounted on an upwardly-extending annular shoulder 28 of the base 12. A threaded pin 24 is integral with an extends upwardly from the base 12 for receiving a nut 30. The measuring arm 26 is provided with an annular upwardly-extending shoulder for receiving a washer 33. A spring washer 32 is located between the washer 33 and the nut 30 so that as the nut 30 is tightened on the pin 24, the arm 26 is clamped against rotation relative to the base 12. As shown in FIG. 1, the measuring arm 26 is provided with two parallel straight edges 34 and 35, each edge being equidistant from the axis 25. The upper surface of the measuring arm 26 is provided with a linear measuring scale, generally indicated by the reference numeral 36.

Figure 5:
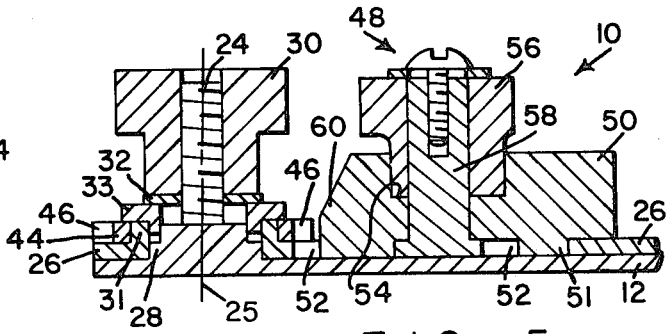
FIG. 5 is a view similar to FIG. 4 showing the locking means disengaged from its locking relationship with the indicator arm.

An indicator arm 38 is mounted on the shoulder 31 of the measuring arm 26 for rotation about axis 25. The indicator arm 38 has a laterally-extending portion 40 provided with an indicator mark 41 spaced from the axis 25 so that it coincides with the marks on the degree scale 22. Means are provided for locking the indicator arm 38 relative to the measuring arm. The end of the indicator arm which rests on the shoulder 31 has a circular enlargement 44 which is provided with a plurality of notches 46 located equidistant from axis 25 and disposed at 90° integrals along the portion 44. A latch, generally indicated by the reference numeral 48, consists of a block 50 mounted on the arm 26 for sliding movement toward and away from the axis 25. The measuring arm 26 is provided with guide slots 52 for receiving downwardly-extending fingers extending from the bottom of the block 50. The upper end of block 50 is provided with a horizontal groove 54 for receiving a cam 56 rotatably mounted on a vertical post 58 which is fixed to the measuring arm 26. The inner end of block 50 is provided with a dog 60 that fits into any one of the notches 46 when the notch is aligned with the dog. Rotation of cam 56 causes the block 50 to move toward and away from the axis 25 between a locking position in which the dog 60 is located in one of the notches 46, as shown in FIG. 4, to an unlocking position in which the dog 46 is moved out of engagement with one of the notches, as shown in FIG. 5. The notches 46 are located at predetermined positions on the indicator arm 38 so that when the indicator arm is locked in each of the positions, the angle indicated by the mark 41 on the scale 22 coincides with the angle formed between one of the straight edges 34 and 35 of the measuring arm 26 and one of the straight edges 14 and 16 of the base. The range of angles which can be measured by the protractor differs for each setting of the indicator arm 38 relative to the measuring arm 26.

Figure 6:
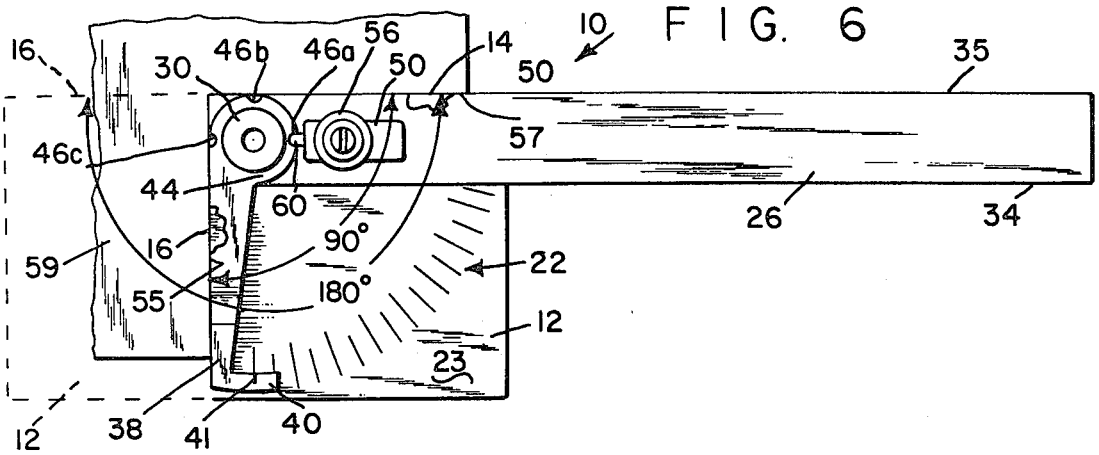
FIGS. 6, 7 and 8 are diagrammatic operational views showing the indicator arm in each of three different locations relative to the measuring arm and showing the range of angles that can be measured with each setting.
Figure 7:
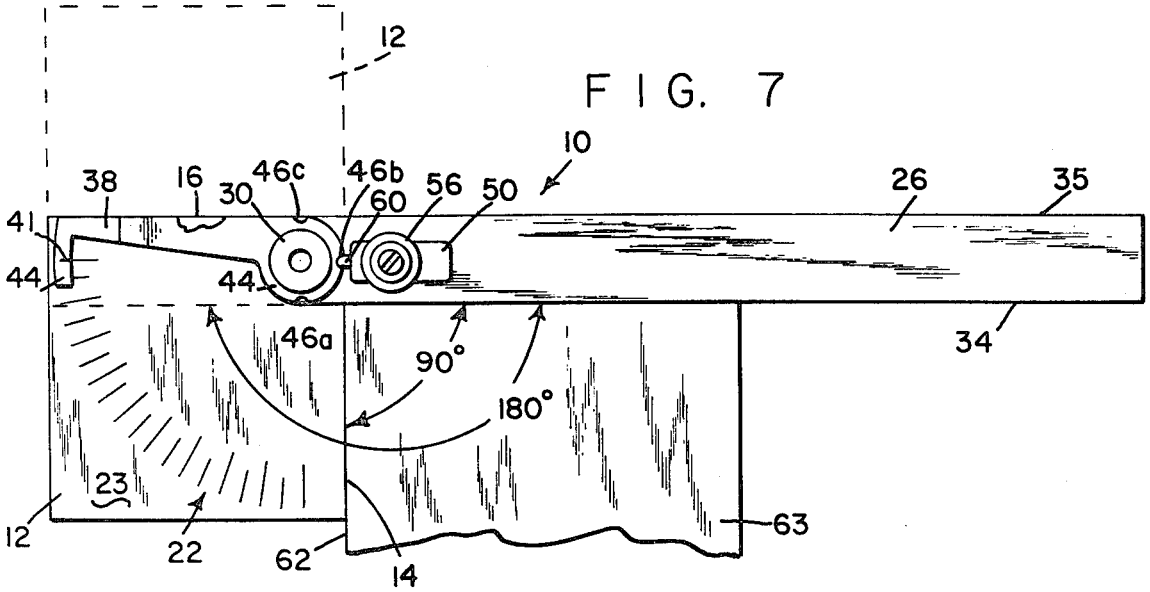
Figure 8:
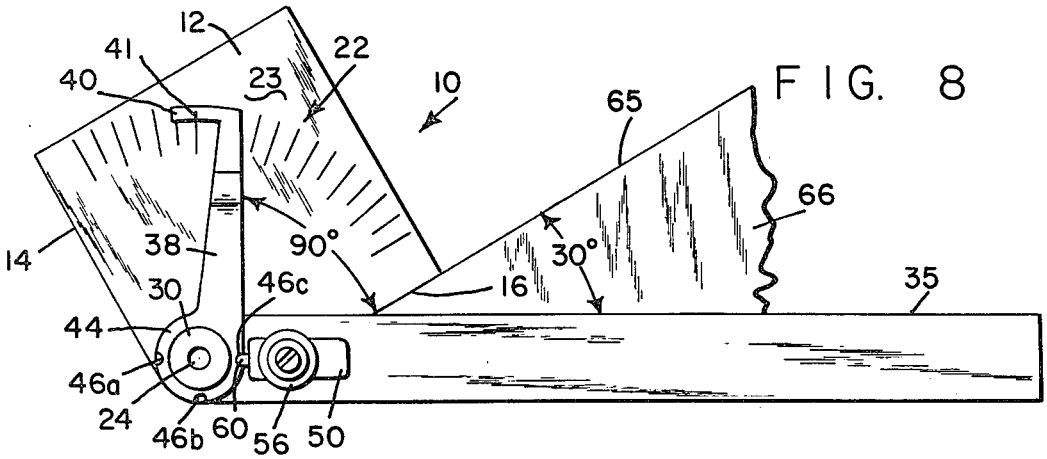

The operation and advantages of the present invention will now be readily understood in view of the above description. The range of angles which can be measured for each setting of the protractor are clearly illustrated in FIGS. 6–8. Referring to FIGS. 6–8 the notches 46 that correspond to each of these settings are identified at **46*a*, 46*b*, and 46*c*. The first setting is shown in FIG. 6 in which the dog 60 is engaged with notch 46*a*. In this setting, the protractor is used to measure inside machine angles between 90° and 180°. In this setting, the edge 35 of the measuring arm 26 rests along one of the surfaces, indicated at 57, of a machine or workpiece 59 and straight edge 16 of the base 12 rests along the other machine surface, indicated at 55. The angle between the two machine surfaces 55 and 57 is measured by reading the point on the scale 22 that is indicated by indicator mark 41. An angle of 90° is indicated by the full line position of the protractor 10 in FIG. 6. All inside angles from 90° to 180° can be measured in this setting. An angle of 180° is indicated by the dotted line position of the base 12 in FIG. 6**.

FIG. 7 shows the second setting of the protractor in which the dog 60 is engaged with notch **46*b*. In this setting, the protractor can be used to measure outside angles between 90° and 180° of two adjacent machine surfaces. The straight edge 34 of the measuring arm 26 rests along one of the machine surfaces and the straight edge 14 of the base rests along the other machine surface. The angle of one machine surface relative to the other is determined by reading the degree scale indicated by the mark 41. The setting shown in full line in FIG. 7 shows the measurement of a pair of 90° can be measured by moving the base counterclockwise relative to measuring arm 26, as viewed in FIG. 7. Angles of up to 180° can be measured as indicated by the dotted line position of the base 12 in FIG. 7**.

The third setting of the protractor 10 is shown in FIG. 8 in which the dog 60 is engaged with notch **46*c*. In this setting, outside angles between approximately 30° and 90° can be measured between two adjacent machine surfaces. In this setting, the straight edge 35 of measuring arm 16 extends along one surface 64 of a workpiece 66 and the straight edge 16 of the base 12 extends along the other surface 65 of the workpiece 66. In the full line position shown in FIG. 8, the indicator 41 measures an angle of 30° of the scale 22 which corresponds to the 30° angle between surfaces 64 and 65 of the workpiece. It becomes increasingly more difficult to measure angles of less than 30° in this setting, since the straight edges 16 and 35 converge as the base 12 is moved clockwise toward the measuring arm 26. The lower range of outside angles that can be measured by the protractor can be extended somewhat by increasing the length of the straight edge 16. Outside angles of greater than 30° are measured by the protractor 10 using the setting shown in FIG. 8 by moving the base 12 counterclockwise up to a maximum of 90°, as indicated by the dotted line position of the base in FIG. 8**.

Figure 9:
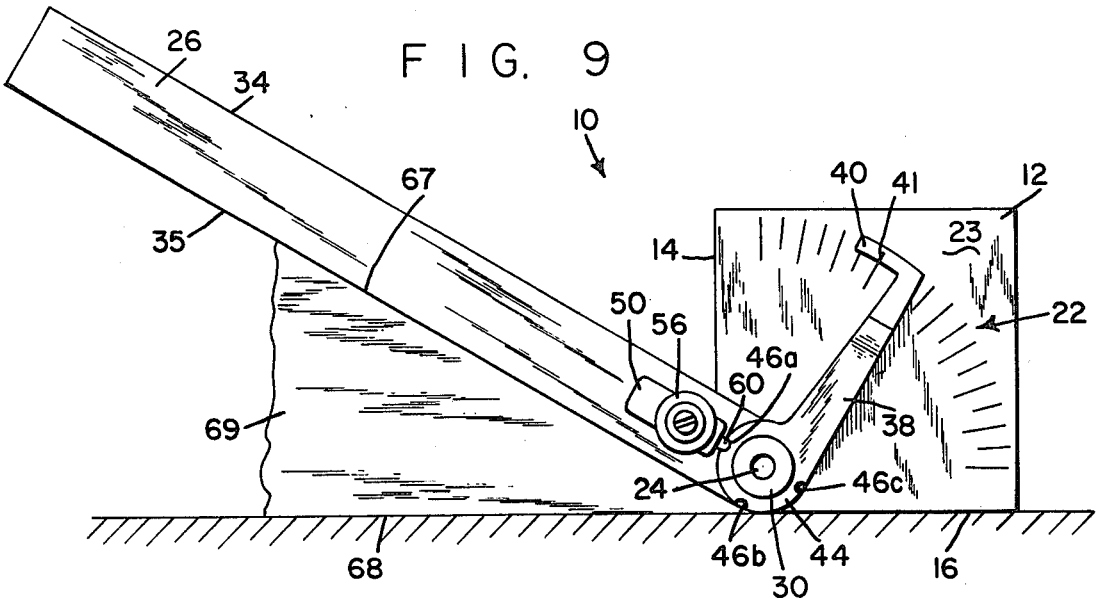
FIG. 9 is a view similar to FIGS. 6, 7 and 8 showing an alternate use of the protractor.

Outside angles of less than 30° can be measured by using the setting shown in FIG. 6, provided that one of the surfaces of the workpiece can be placed on a flat supporting surface. This procedure is illustrated in FIG. 9, wherein the protractor 10 is used to measure the angle between surfaces 67 and 68 of a workpiece 69. Surface 68 is placed on a flat supporting surface 70 and the straight edge 16 of the base is placed on the supporting surface 70 adjacent apex 71 of the surfaces 67 and 68. The straight edge 35 of the measuring arm 26 is then placed on the surface 67. The angle between the surfaces 67 and 69 is determined by reading the scale 22 at the point indicated by the mark 41. It is also possible to measure the angle between the surfaces 67 and 68 by rotating the workpiece 69 180° on the surface 70 and placing the straight edge 35 of the measuring arm on the supporting surface. The straight edge 16 of the base is then placed on the surface 67 and the scale 22 is read as above. When the protractor 10 is used in the manner shown in FIG. 9, it is capable of measuring outside angles between 0° and 90°.

Protractor 10 can be used by draftsmen to measure any angle on a planar surface by using the settings provided by notches 46*a*, 46*b*, and 46*c*. The versatility of the protractor also enables it to be used by machinists and draftsmen in situations involving machines and their drawings. As for example, in the manufacture of machines or parts from drawings or checking drawings with existing machines or workpieces.

It is preferred that the compass be constructed of metal such as steel to assure accuracy of measurement and durability.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and described to secure by Letters Patent is:

1. Protractor comprising:

(a) a flat base having a corner portion, a first straight edge extending from the corner portion, a second straight edge extending from the corner portion at a right angle to the first straight edge and a degree scale extending between said first and second edges along a circular arc generated from a point on the corner portion, (b) a measuring arm mounted on the base for rotation about said point and having straight edges for cooperating with either of said first and second straight edges to form an angle corresponding to an angle to be measured, (c) an indicator arm mounted on the measuring arm for rotation about said point and having an indicator mark spaced from said point so that the mark coincides with said degree scale, and (d) locking means for fixing the indicator arm in a plurality of predetermined positions on the measuring arm so that in each position, the angle indicated by the mark on the scale coincides with the angle formed between at least one of the said first and second straight edges and one of the straight edges of the measuring arm, and the range of angles measured by the protractor is different for each of said predetermined positions.

2. Protractor as recited in claim 1, wherein the corner portion has a curved edge that is tangential with said first and second straight edges.

3. Protractor as recited in claim 2, wherein said curved edge is a circular arm generated from said point.

4. Protractor as recited in claim 3, wherein the straight edges of the measuring arm are two spaced parallel straight edges, one of said parallel edges cooperating with said first straight edge and the other of said parallel edges cooperating with said second straight edge.

5. Protractor as recited in claim 4, wherein the measuring arm has a circular end edge that is tangential with said parallel edges and concentric with said curved edge.

6. Protractor as recited in claim 1, wherein said locking means comprises:

(a) a circular enlargement of the indicator arm about said point and provided with a plurality of spaced notches, each notch being equidistant from said point, and (b) a latch member mounted on the measuring arm and having a dog that is movable along an axis that intersects said point for engaging any one of said notches when the notch is aligned with said dog.

7. Protractor as recited in claim 6, wherein said notches are located at 90° intervals about said circular enlargement.

8. Protractor as recited in claim 6, wherein the latch member comprises:

(a) a block integral with the dog and mounted on the measuring arm for sliding movement along said axis, and (b) a cam rotatably mounted on the measuring arm and operatively connected to the block for causing the block to move along said axis and enabling the dog to move into and out of locking engagement with said aligned notch.

9. Protractor as recited in claim 1, wherein clamping means are provided for locking the indicator arm on the measuring arm.

10. Protractor as recited in claim 9, wherein said clamping means comprises:

(a) a pin fixed to the base and extending freely through the measuring and indicator arms, transversely from the base at said point, said pin having a threaded end, and (b) a nut threadedly mounted on the pin.

* * * * *